US011104360B2

(12) United States Patent
Ono et al.

(10) Patent No.: US 11,104,360 B2
(45) Date of Patent: Aug. 31, 2021

(54) METHOD OF ASSEMBLING RAILCAR BOGIE, MEASUREMENT JIG, AND RAILCAR BOGIE

(71) Applicant: KAWASAKI JUKOGYO KABUSHIKI KAISHA, Kobe (JP)

(72) Inventors: Takaya Ono, Kobe (JP); Yukitaka Taga, Kobe (JP); Fumikazu Kounoike, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 383 days.

(21) Appl. No.: 16/302,597

(22) PCT Filed: Mar. 21, 2017

(86) PCT No.: PCT/JP2017/011269
§ 371 (c)(1),
(2) Date: Nov. 16, 2018

(87) PCT Pub. No.: WO2017/199573
PCT Pub. Date: Nov. 23, 2017

(65) Prior Publication Data

US 2019/0291753 A1 Sep. 26, 2019

(30) Foreign Application Priority Data

May 16, 2016 (JP) ..... JP2016-098098

(51) Int. Cl.
*B61F 5/52* (2006.01)
*B61F 3/02* (2006.01)
(Continued)

(52) U.S. Cl.
CPC ..... *B61F 5/52* (2013.01); *B61F 3/02* (2013.01); *B61F 5/00* (2013.01); *B61F 5/30* (2013.01); *B61F 5/32* (2013.01); *B61F 15/20* (2013.01)

(58) Field of Classification Search
CPC ..... B61F 5/00; B61F 5/32; B61F 5/50; B61F 5/52; B61F 5/302; B61F 5/02–12; B23K 3/087; B23K 37/0443
See application file for complete search history.

(56) References Cited

U.S. PATENT DOCUMENTS 4,108,080 A * 8/1978 Garner ..... B61F 1/12 105/182.1
5,238,333 A * 8/1993 Dugge ..... B65D 90/623 105/247
(Continued)

FOREIGN PATENT DOCUMENTS

CN 203031591 U * 7/2013
CN 203031591 U 7/2013
(Continued)

*Primary Examiner* — Zachary L Kuhfuss
*Assistant Examiner* — Cheng Lin
(74) *Attorney, Agent, or Firm* — Oliff PLC

(57) ABSTRACT

A method of assembling a railcar bogie includes: a plate spring arranging step of making a pair of axle boxes support a plate spring extending in a car longitudinal direction, the axle boxes being arranged away from each other in the car longitudinal direction; a bogie frame arranging step of placing a bogie frame directly or indirectly on a longitudinal direction middle portion of the plate spring from above, the bogie frame including a side wall on which an opening is formed, the side wall covering the plate spring from an outside in a car width direction; and a measuring step of measuring a positional deviation between the plate spring and the bogie frame in the car longitudinal direction through the opening.

9 Claims, 6 Drawing Sheets

(51) Int. Cl.

| | |
|---|---|
| ***B61F 5/32*** | (2006.01) |
| ***B61F 15/20*** | (2006.01) |
| ***B61F 5/30*** | (2006.01) |
| ***B61F 5/00*** | (2006.01) |

(56) References Cited

U.S. PATENT DOCUMENTS

| | | | | |
|---|---|---|---|---|
| 5,295,444 | A * | 3/1994 | Irle | B61F 3/02 105/199.1 |
| 5,481,986 | A * | 1/1996 | Spencer | B61F 5/52 105/206.1 |
| 8,844,447 | B2 * | 9/2014 | Goding | B61F 5/52 105/172 |
| 2014/0137765 | A1 | 5/2014 | Nishimura et al. | |
| 2014/0144347 | A1 | 5/2014 | Nishimura et al. | |

FOREIGN PATENT DOCUMENTS

| | | | | |
|---|---|---|---|---|
| JP | 2013-035536 | A | 2/2013 | |
| WO | 2013/008468 | A1 | 1/2013 | |
| WO | WO-2013128784 | A1 * | 9/2013 | B61F 3/08 |
| WO | WO-2014109279 | A1 * | 7/2014 | B61F 5/305 |

* cited by examiner

METHOD OF ASSEMBLING RAILCAR BOGIE, MEASUREMENT JIG, AND RAILCAR BOGIE

TECHNICAL FIELD

The present invention relates to a method of assembling a railcar bogie, a measurement jig, and a railcar bogie.

BACKGROUND ART

PTL 1 proposes a railcar bogie from which side sills of a bogie frame of the bogie are omitted. In this bogie, a pair of front and rear axle boxes support both respective end portions of a plate spring extending in a car longitudinal direction, and a middle portion of the plate spring supports a cross beam of the bogie frame. To be specific, the plate spring has both the function of a primary suspension and the function of a conventional side sill. The bogie frame includes a pair of receiving seats which project from an end portion of the cross beam and to which an axle beam is coupled. The plate spring passes through a space sandwiched between the pair of receiving seats. Therefore, the pair of receiving seats also play a role of covering the longitudinal direction middle portion of the plate spring in a car width direction.

CITATION LIST

Patent Literature

PTL 1: International Publication No. 2013/008468

SUMMARY OF INVENTION

Technical Problem

In order to make the plate spring function as designed, a car longitudinal direction center of the plate spring and a car longitudinal direction center of the bogie frame need to coincide with each other.

As above, the car longitudinal direction middle portion of the plate spring is covered with the receiving seat (side wall) of the bogie frame from an outside in the car width direction. Therefore, in order to directly confirm whether or not the above centers coincide with each other, an assembly operator needs to get under the bogie and look at the plate spring from below, which is low in a work property.

Further, a positional deviation between the above centers may be estimated by confirming a positional deviation between a receiving member provided at an upper end portion of the axle box and a longitudinal direction end portion of the plate spring. However, since an accumulated error during assembly may occur in a positional relation between the bogie frame and the receiving member, this estimating method lacks accuracy.

An object of the present invention is to improve both an assembling work property and assembly accuracy of a bogie in which a side wall of a bogie frame covers a plate spring from an outside in a car width direction.

Solution to Problem

A method of assembling a railcar bogie according to one aspect of the present invention includes: a plate spring arranging step of making a pair of axle boxes support a plate spring extending in a car longitudinal direction, the axle boxes being arranged away from each other in the car longitudinal direction; a bogie frame arranging step of placing a bogie frame directly or indirectly on a longitudinal direction middle portion of the plate spring from above, the bogie frame including a side wall on which an opening is formed, the side wall covering the plate spring from an outside in a car width direction; and a measuring step of measuring a positional deviation between the plate spring and the bogie frame in the car longitudinal direction through the opening.

A railcar bogie according to another aspect of the present invention includes: a plate spring extending in a car longitudinal direction and supported by a pair of axle boxes arranged away from each other in the car longitudinal direction; and a bogie frame including a side wall covering the plate spring from an outside in a car width direction, the side wall including an opening through which a side surface of the plate spring is exposed, the bogie frame being placed directly or indirectly on a longitudinal direction middle portion of the plate spring from above.

According to the above method and configuration, the positional deviation between the plate spring and the bogie frame in the car longitudinal direction can be easily and directly measured by visually confirming the plate spring through the opening of the side wall. Therefore, it is possible to improve both the assembling work property and assembly accuracy of the bogie in which the side wall of the bogie frame covers the plate spring from an outside in the car width direction.

Advantageous Effects of Invention

According to the present invention, it is possible to improve both the assembling work property and assembly accuracy of the bogie in which the side wall of the bogie frame covers the plate spring from an outside in the car width direction.

DESCRIPTION OF EMBODIMENTS

Hereinafter, an embodiment will be explained with reference to the drawings. In the following explanation, a direction in which a railcar travels and a car body extends is defined as a car longitudinal direction, and a crosswise direction perpendicular to the car longitudinal direction is defined as a car width direction. The car longitudinal direction is also referred to as a front-rear direction, and the car width direction is also referred to as a left-right direction.

Figure 1:
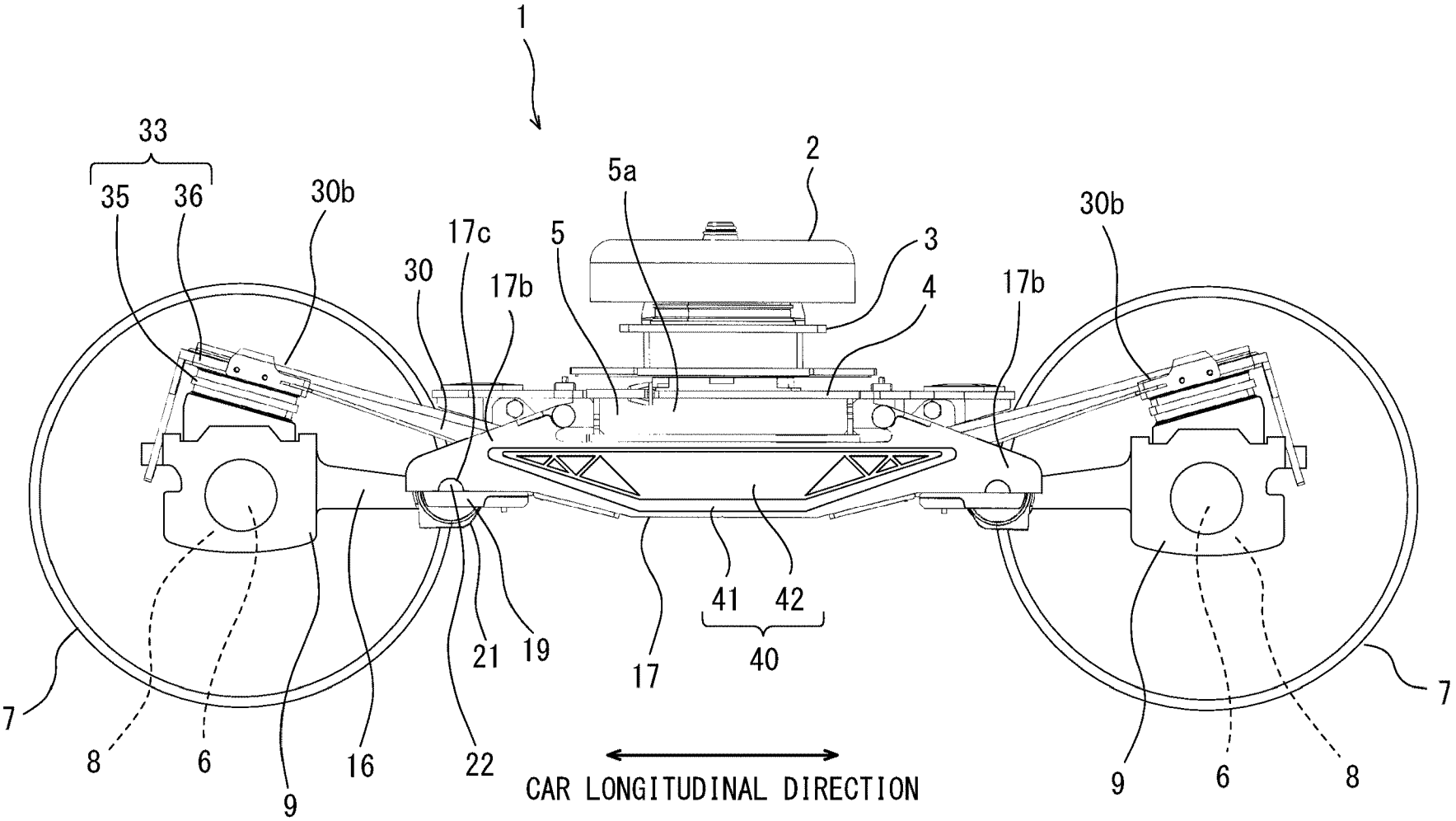
FIG. 1 is a side view of a railcar bogie according to an embodiment.
Figure 2:
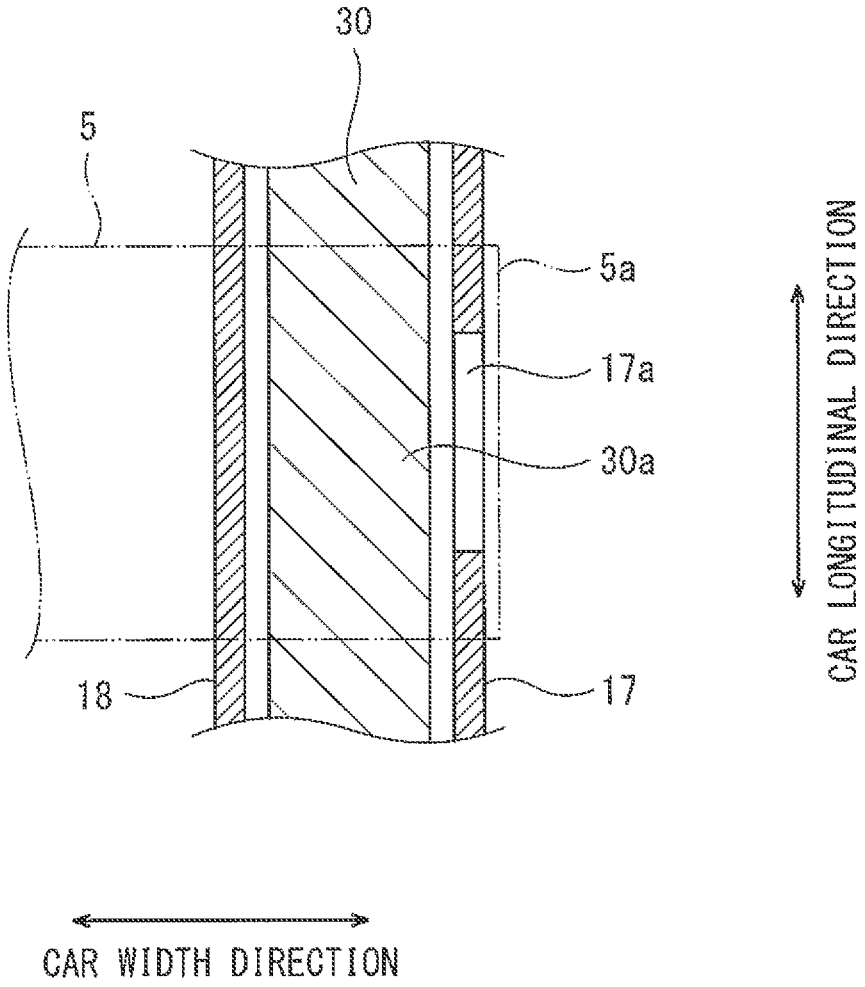
FIG. 2 is a horizontal sectional view of major components of the bogie shown in FIG. 1.
Figure 3:
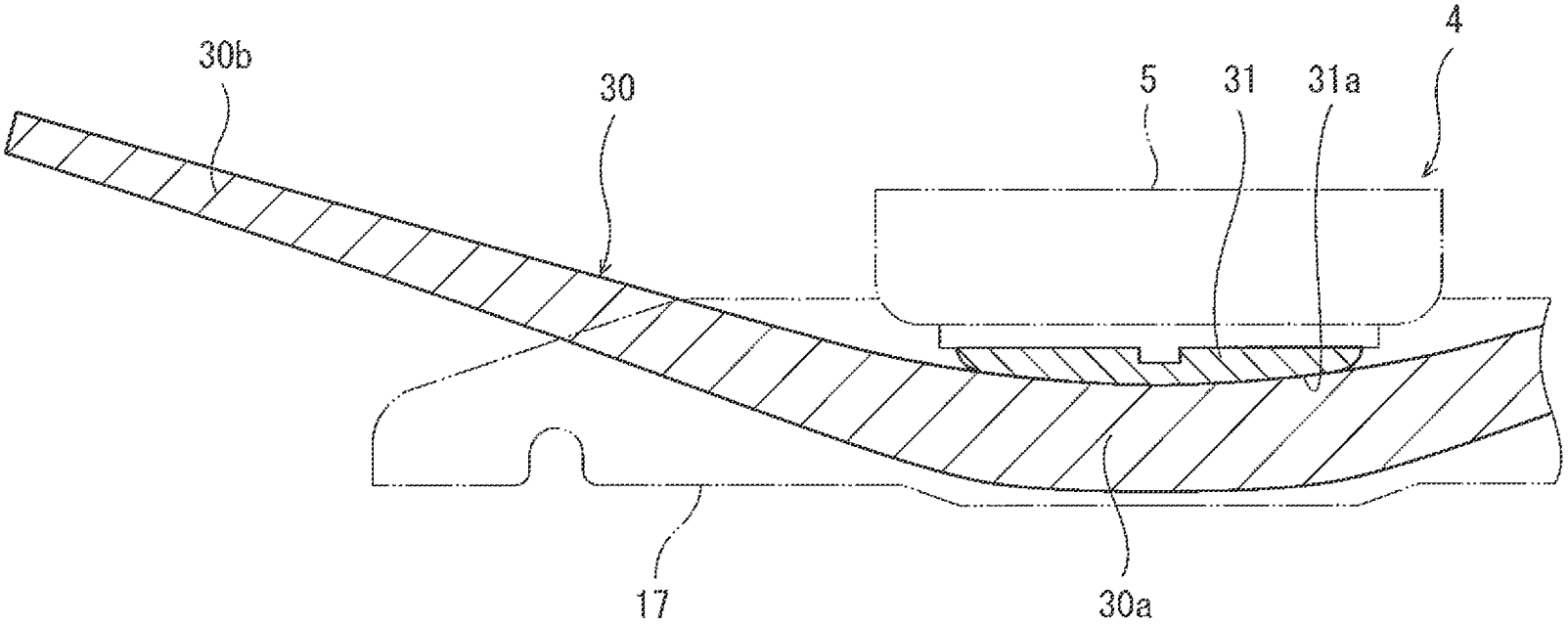
FIG. 3 is a vertical sectional view of major components of the bogie shown in FIG. 1.

FIG. 1 is a side view of a railcar bogie 1 according to the embodiment. FIG. 2 is a horizontal sectional view of major components of the bogie 1 shown in FIG. 1. FIG. 3 is a vertical sectional view of major components of the bogie 1 shown in FIG. 1. It should be noted that in FIG. 2, a below-described lid 40 is not shown. As shown in FIGS. 1 to 3, the railcar bogie 1 includes a bogie frame 4 supporting a car body through an air spring 2 as a secondary suspension and a bolster 3. The bogie frame 4 includes a cross beam 5 extending in the car width direction and supporting the car body but does not include so-called side sills.

The cross beam 5 is connected to the bolster 3 so as to be turnable, and the bolster 3 is connected to the car body through the air spring 2 and a bolster anchor (not shown). A pair of axles 6 extending in the car width direction are arranged at both respective car longitudinal direction sides of the cross beam 5. Wheels 7 are fixed to both respective car width direction sides of each axle 6. Bearings 8 rotatably supporting the axle 6 are provided at both respective car width direction end portions of the axle 6 so as to be located outside the corresponding wheels 7 in the car width direction. The bearings 8 are accommodated in respective axle boxes 9.

A pair of front and rear axle boxes 9 arranged away from each other in the car longitudinal direction support both respective end portions 30*b* of a plate spring 30 extending in the car longitudinal direction. A longitudinal direction middle portion 30*a* of the plate spring 30 supports a car width direction end portion 5*a* of the cross beam 5. To be specific, the plate spring 30 has both the function of a primary suspension and the function of a conventional side sill. The plate spring 30 is made of, for example, fiber-reinforced resin. In a side view, the plate spring 30 is formed in an arch shape that is convex downward as a whole. The middle portion 30*a* of the plate spring is located lower than the end portions 30*b* and has a circular-arc shape that is convex downward.

The bogie frame 4 includes a pressing member 31 and a pair of side walls 17 and 18. The pressing member 31 is provided at a lower portion of the end portion 5*a* of the cross beam 5. The pair of side walls 17 and 18 are arranged at both respective car width direction sides of the pressing member 31 and projects from the end portion 5*a* of the cross beam 5 toward a lower side and both sides in the car longitudinal direction. The middle portion 30*a* of the plate spring 30 is located under the pressing member 31. The plate spring 30 passes in the car longitudinal direction through a space sandwiched between the pair of side walls 17 and 18. The plate spring 30 is arranged so as to be spaced apart from each of the side walls 17 and 18 in the car width direction. In a side view, the middle portion 30*a* of the plate spring 30 is arranged so as to overlap the side walls 17 and 18.

The pressing member 31 includes a circular-arc lower surface 31*a*. The pressing member 31 is placed on the middle portion 30*a* of the plate spring 30 from above. The pressing member 31 presses an upper surface of the plate spring 30 by gravitational downward load from the cross beam 5 without being fixed to the plate spring 30 so as to be separable from the upper surface of the plate spring 30. To be specific, the pressing member 31 presses the upper surface of the plate spring 30 without being connected to the plate spring 30 by a fixture (such as a bolt). In other words, the pressing of the pressing member 31 against the upper surface of the plate spring 30 is kept by the gravitational downward load from the cross beam 5 and reaction force of the plate spring 30. With this, the plate spring 30 can swing while changing a region pressed against the lower surface 31*a* of the pressing member 31. It should be noted that the bogie frame 4 may be directly or indirectly placed on the upper surface of the middle portion 30*a* of the plate spring 30. A buffer sheet may be interposed between the pressing member 31 and the plate spring 30.

Upper surfaces of the axle boxes 9 are inclined toward a longitudinal direction middle side. Spring seats 33 are attached to respective upper portions of the axle boxes 9. The end portions 30*b* of the plate spring 30 are placed on the respective spring seats 33 from above. To be specific, the end portions 30*b* of the plate spring 30 are supported by the respective axle boxes 9 through the corresponding spring seats 33. Each of the spring seats 33 includes an elastic body 35 (such as a multi-layer rubber) and a receiving member 36. The elastic body 35 is positioned on the upper surface of the axle box 9. The receiving member 36 is positioned on the elastic body 35, and the end portion 30*b* of the plate spring 30 is placed on the receiving member 36. Upper surfaces of the end portions 30*b* of the plate spring 30 are inclined in a direction toward the middle portion 30*a*.

An axle beam 16 is provided at each axle box 9. The axle beam 16 projects from the axle box 9 toward a bogie middle side in the car longitudinal direction. A tubular portion 21 is provided at a tip end portion of the axle beam 16. The tubular portion 21 includes a cylindrical inner peripheral surface and opens at both sides in the car width direction. A core rod 22 is inserted into an internal space of the tubular portion 21 through a rubber bushing (not shown). Fitting grooves 17*c* that are open downward are formed at the respective side walls 17 and 18. Both end portions of the core rod 22 are fitted to the fitting grooves 17*c* from below. Cover members 19 are fixed to the respective side walls 17 and 18 from below by bolts (not shown) so as to close lower openings of the fitting grooves 17*c* and support the core rod 22 from below.

Figure 4:
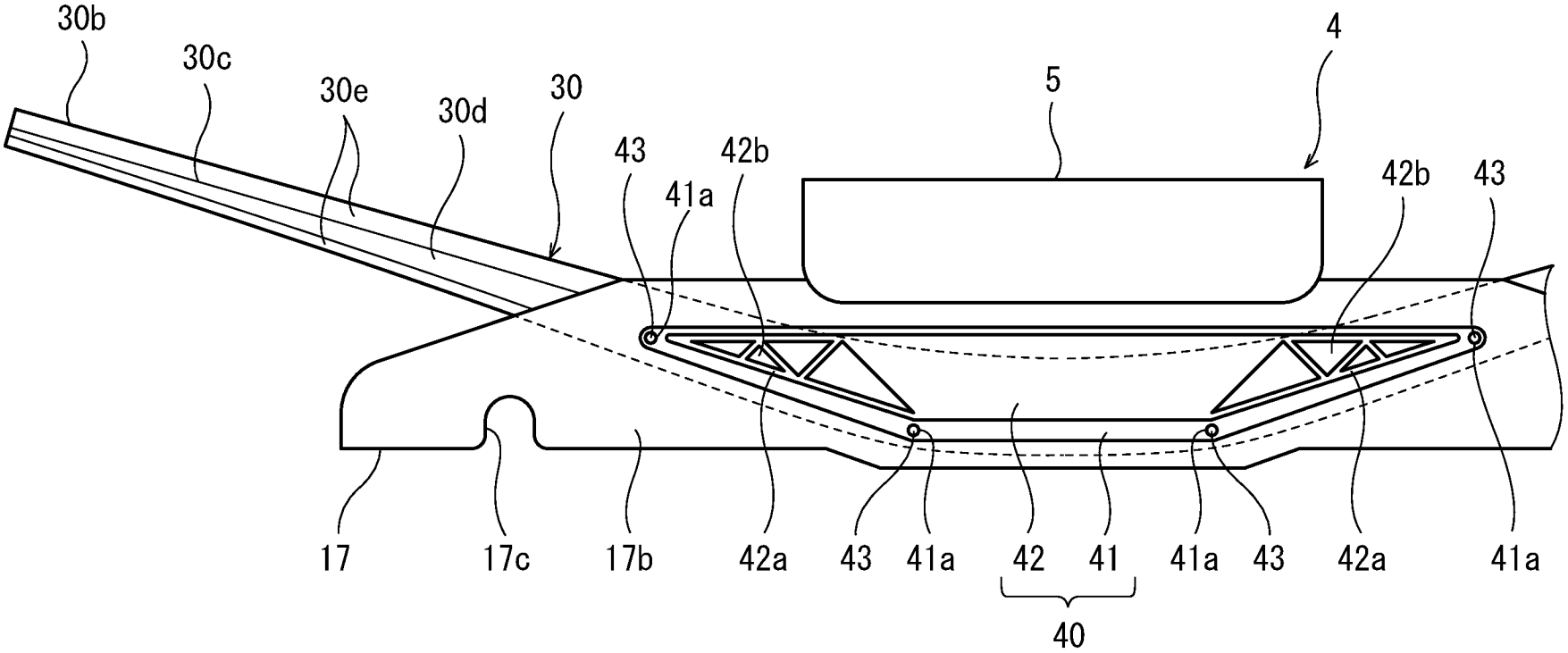
FIG. 4 is a side view of major components of the bogie shown in FIG. 1.
Figure 5:
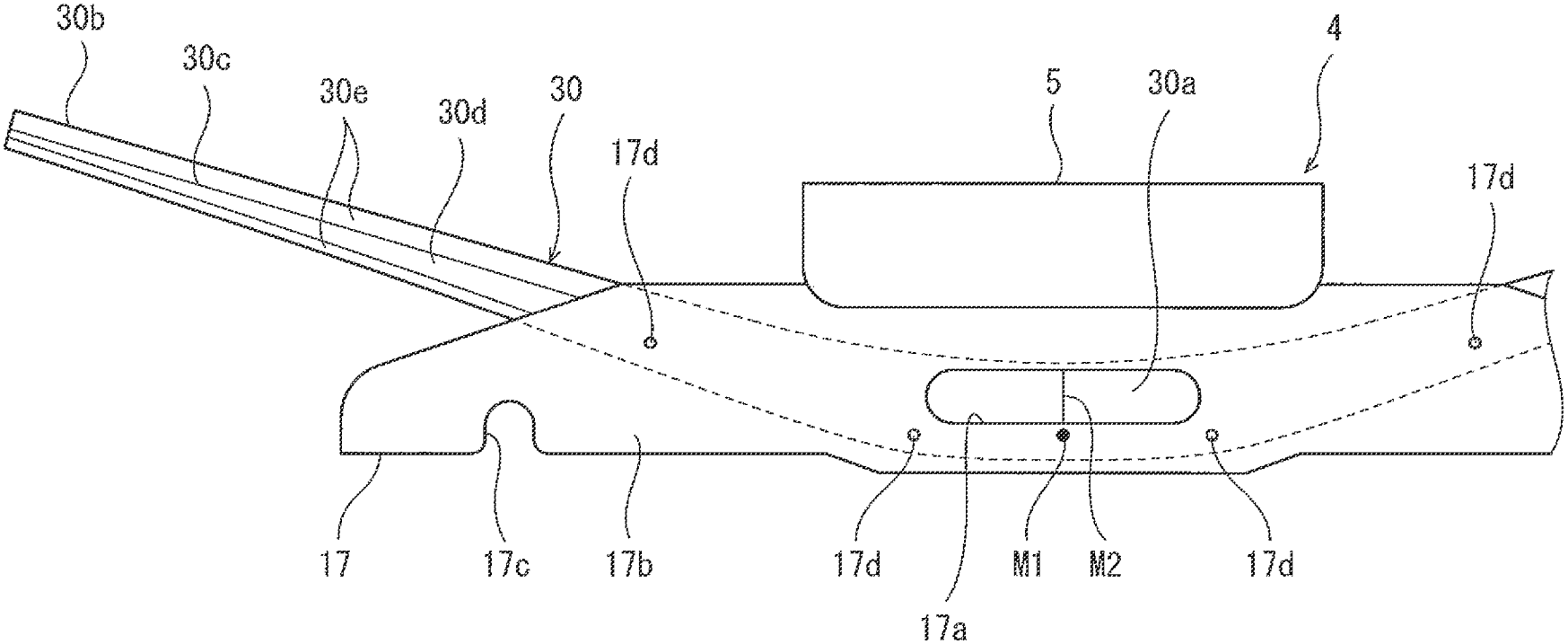
FIG. 5 is a side view of the bogie of FIG. 4 from which a lid is detached.

FIG. 4 is a side view of major components of the bogie 1 shown in FIG. 1. FIG. 5 is a side view of the bogie 1 of FIG. 4 from which the lid 40 is detached. As shown in FIGS. 4 and 5, the middle portion 30*a* of the plate spring 30 is covered with the side wall 17 from an outside in the car width direction. The side wall 17 includes an opening 17*a* through which a car width direction outer side surface of the middle portion 30*a* of the plate spring 30 is exposed. In a side view, the opening 17*a* is arranged in a region contained in a side surface 30*c* of the plate spring 30. The opening 17*a* is a hole that is long in the car longitudinal direction. In the present embodiment, the opening 17*a* has an oval shape. The opening 17*a* is used to measure a positional deviation between the plate spring 30 and the bogie frame 4, and in addition, serves as a hole for weight reduction. A vertical size of the opening 17*a* is smaller than a vertical thickness of the plate spring 30, and a car longitudinal direction size of the opening 17*a* is larger than the vertical thickness of the plate spring 30.

A marking M1 (for example, a punch mark) is provided on a car width direction outer side surface 17*b* of the side wall 17 so as to be located in the vicinity of the opening 17*a*. Specifically, the marking M1 is provided under the opening 17*a*. The marking M1 is provided at a car longitudinal direction center of the bogie frame 4. In the present embodiment, in a side view, the opening 17*a* is formed symmetrically about the car longitudinal direction center of the bogie frame 4, and the marking M1 is provided at the same position as a center of the opening 17*a* in the car longitudinal direction.

The car width direction outer side surface 30*c* of the plate spring 30 includes a plurality of colored portions 30*d* and 30*e*. In the present embodiment, the first colored portion 30*d* and the second colored portions 30*e* are painted so as to extend along the longitudinal direction of the plate spring 30. The first colored portion 30*d* has a first color, and the second colored portions 30*e* have a second color different from the first color. For example, the first color is a dark color (such as black or deep blue) having brightness of not less than 0% and less than 50%, and the second color is a bright color (such as red, blue, or green) having brightness of not less than 50% and not more than 100%. A marking M2 (for example, a marking line extending in a vertical direction) is provided at a side surface of the middle portion 30*a* of the plate spring 30 so as to be located at a longitudinal direction center of the plate spring 30. When the lid 40 is detached, the marking M2 is visually confirmed from a car width direction outer side of the side wall 17 through the opening 17*a*.

The car width direction outer side surface 17*b* of the side wall 17 has the first color. To be specific, the side surface 17*b* of the side wall 17 has the same color as the first colored portion 30*d* of the plate spring 30. Attachment holes 17*d* to which the lid 40 is attached are formed at predetermined positions on the side wall 17. The opening 17*a* is closed by the lid 40 attached to the side wall 17. In a side view, the lid 40 is arranged so as to overlap the plate spring 30 through the side surface 17*b*. When viewed from an outside in the car width direction, the area of the lid 40 is twice or more the area of the opening 17*a*. The lid 40 has such a shape that a car longitudinal direction size thereof is longer than a vertical size thereof.

The lid 40 includes a first plate 41 and a second plate 42. The first plate 41 includes attachment holes 41*a* that coincide with the respective attachment holes 17*d* of the side wall 17. The second plate 42 is stacked on and joined to the first plate 41 from an outside in the car width direction and is smaller in area than the first plate 41. Specifically, a peripheral portion of the first plate 41 protrudes to an outside of the second plate 42, and the second plate 42 is arranged so as to avoid the attachment holes 41*a*. An outer peripheral contour of the second plate 42 is similar to an outer peripheral contour of the first plate 41. The lid 40 is detachably fixed to the side wall 17 by inserting fixtures 43 (for example, bolts) into the attachment holes 17*d* and 41*a*.

The first plate 41 and the second plate 42 have respective colors different from each other. A car width direction outside surface of the first plate 41 has the first color. To be specific, the car width direction outside surface of the first plate 41 has the same color as the car width direction outer side surface 17*b* of the side wall 17 and the first colored portion 30*d* of the plate spring 30. A car width direction outside surface of the second plate 42 has the second color. To be specific, the second plate 42 has the same color as the second colored portions 30*e* of the plate spring 30.

Each of both car longitudinal direction end portions 42*a* of the second plate 42 tapers in a direction in which the plate spring 30 extends. To be specific, in a side view, a region of the lid 40 which region has the same color as the second colored portions 30*e* of the plate spring 30 extends toward a portion of the plate spring 30 which portion is exposed to an outside of the side wall 17. In a side view, the end portions 42*a* of the second plate 42 are arranged so as to overlap the plate spring 30 through the side surface 17*b*. The end portions 42*a* of the second plate 42 include a plurality of holes 42*b*. The first plate 41 can be visually confirmed through the holes 42*b*.

Next, characteristic matters in a procedure of assembling the bogie 1 will be explained. Before the bogie frame 4 is provided, an operator places, from above, the end portions 30*b* of the plate spring 30 on the respective receiving members 36 provided on the pair of axle boxes 9 arranged away from each other in the car longitudinal direction (plate spring arranging step). Next, the operator places the bogie frame 4, to which the lid 40 is not yet attached, on the plate spring 30 (bogie frame arranging step). At this time, the pair of side walls 17 and 18 are arranged at both respective car width direction sides of the middle portion 30*a* of the plate spring 30, and the pressing member 31 of the bogie frame 4 is placed on the upper surface of the middle portion 30*a* of the plate spring 30. With this, the middle portion 30*a* of the plate spring 30 is covered with the side wall 17 from an outside in the car width direction.

Figure 6:
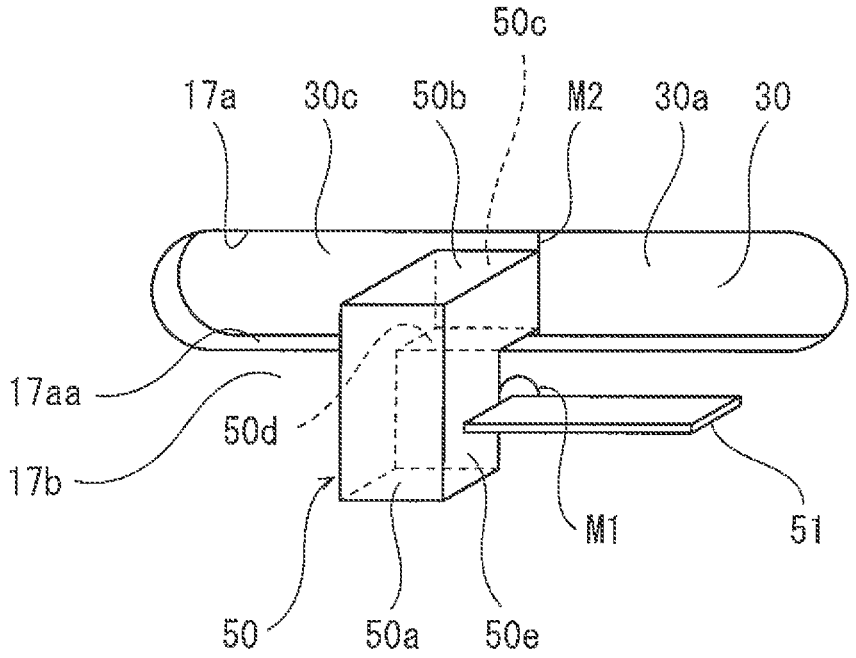
FIG. 6 is a diagram for explaining a measuring step in assembling of the bogie shown in FIG. 5.

Next, as shown in FIG. 6, the operator uses a measurement jig 50 and a scale 51 to measure a positional deviation between the plate spring 30 and the bogie frame 4 in the car longitudinal direction (measuring step). The measurement jig 50 includes a vertical portion 50*a* and a horizontal portion 50*b* and has an L shape as a whole. The vertical portion 50*a* extends in the vertical direction along the side surface 17*b* of the side wall 17, and the horizontal portion 50*b* extends inward in the car width direction from an upper end of the vertical portion 50*a*. The horizontal portion 50*b* of the measurement jig 50 includes a flat contact surface 50*c* and a flat mount surface 50*d*. The contact surface 50*c* is brought into surface contact with the side surface 30*c* of the plate spring 30, and the mount surface 50*d* is mounted on a flat portion 17*aa* of a peripheral surface defining the opening 17*a*. The measurement jig 50 is formed continuously from the vertical portion 50*a* to the horizontal portion 50*b* and includes a measurement surface 50*e* that is a vertical surface having a normal line extending in the car longitudinal direction.

The operator arranges the measurement jig 50 such that the measurement jig 50 is inserted into the opening 17*a* so as to extend from the side surface 17*b* of the side wall 17 to the side surface 30*c* of the plate spring 30. To be specific, the horizontal portion 50*b* is inserted into the opening 17*a* with the vertical portion 50*a* provided along the car width direction outer side surface 17*b* of the side wall 17, and the contact surface 50*c* is brought into contact with the car width direction outer side surface 30*c* of the plate spring 30. At this time, the operator makes the measurement surface 50*e* of the measurement jig 50 coincide with the marking M2 extending in the vertical direction of the plate spring 30. Next, the operator uses the scale 51 to measure a distance (i.e., a positional deviation) between the measurement surface 50*e* of the measurement jig 50 and the center of the marking M1 of the side wall 17 in the car longitudinal direction. Thus, the positional deviation between the marking M2 of the plate spring 30 and the marking M1 of the side wall 17 in the car longitudinal direction is measured.

Next, when the measured positional deviation falls outside an allowable range, the operator moves the plate spring 30 relative to the bogie frame 4 in the car longitudinal direction to reduce the positional deviation (adjusting step). When it is confirmed that the positional deviation between the marking M1 of the plate spring 30 and the marking M2 of the side wall 17 in the car longitudinal direction falls within the allowable range, the operator attaches the lid 40 to the side wall 17 to close the opening 17*a* of the side wall 17 (lid attaching step).

According the above-explained aspect, the positional deviation between the plate spring 30 and the bogie frame 4 in the car longitudinal direction can be easily and directly measured by utilizing the opening 17*a* of the side wall 17 of the bogie frame 4. Therefore, it is possible to improve both the assembling work property and assembly accuracy of the bogie 1 in which the side wall 17 of the bogie frame 4 covers the plate spring 30 from an outside in the car width direction. Especially, according to the bogie 1 of the present embodiment, the plate spring 30 is not fixed to the bogie frame 4. In assembling, an error tends to occur in a relative positional relation between the bogie frame 4 and the plate spring 30 in the car longitudinal direction. On this account, the above-described aspect is effective.

Further, since the opening 17*a* of the side wall 17 is closed by the lid 40, foreign matters (for example, flying stones) flying toward the traveling railcar can be prevented from colliding with the plate spring 30 through the opening 17*a*. Further, the lid 40 includes: the first plate 41 fixed to the side wall 17; and the second plate 42 which is smaller in area than the first plate 41 and has a different color from the first plate 41. Therefore, the lid 40 having plural colors can be easily realized by placing the second plate 42 on the first plate 41. Further, the second plate 42 of the lid 40 has the same color as the second colored portions 30*e* of the plate spring 30. Therefore, even when the middle portion 30*a* of the plate spring 30 is covered with the side wall 17, a sense of unity between the plate spring 30 and the bogie frame 4 in terms of appearance can be created.

Figure 7:
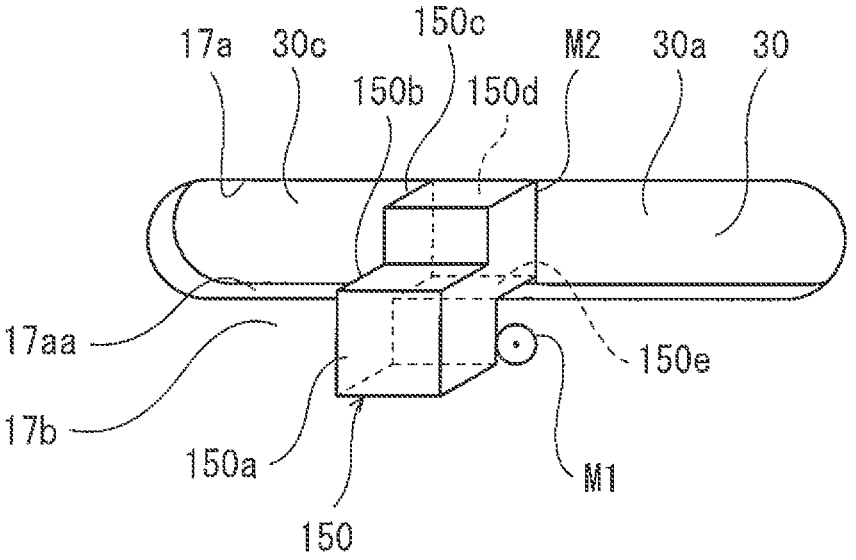
FIG. 7 is a diagram of a modified example of a measurement jig shown in FIG. 6.

FIG. 7 is a diagram of a modified example of the measurement jig 50 shown in FIG. 6. In FIG. 7, the scale 51 is not shown. As shown in FIG. 7, a measurement jig 150 includes a first vertical portion 150*a*, a horizontal portion 150*b*, and a second vertical portion 150*c*. The first vertical portion 150*a* extends in the vertical direction along the side surface 17*b* of the side wall 17. The horizontal portion 150*b* extends inward in the car width direction from an upper end of the first vertical portion 150*a*. The second vertical portion 150*c* extends upward from the horizontal portion 150*b*. The second vertical portion 150*c* includes a flat contact surface 150*d* that is brought into surface contact with the side surface 30*c* of the plate spring 30. The horizontal portion 150*b* includes a flat mount surface 150*e* that is mounted on the flat portion 17*aa* of the peripheral surface defining the opening 17*a*. The measurement jig 150 is formed in a shape having center of gravity at such a position that the measurement jig 150 is kept stationary with the mount surface 150*e* mounted on the flat portion 17*aa* of the opening 17*a* without being held by the operator. The positional deviation between the marking M2 of the plate spring 30 and the marking M1 of the side wall 17 in the car longitudinal direction is measured by using the scale 51 as with FIG. 6.

The present invention is not limited to the above embodiment, and modifications, additions, and eliminations may be made with respect to the configuration of the present invention. For example, the markings M1 and M2 do not have to be located at the car longitudinal direction centers of the plate spring 30 and the bogie frame 4. The markings M1 and M2 are only required to be set such that when the positions of the markings M1 and M2 coincide with each other in the car longitudinal direction, the car longitudinal direction center of the plate spring 30 and the car longitudinal direction center of the bogie frame 4 coincide with each other. Each of the markings M1 and M2 is not limited to a marking line or a punch mark and may be the other form (for example, a notch). The lid 40 is not limited to the configuration in which two plates are stacked on each other. The lid 40 may be one plate. When the lid is one plate, a car width direction outer side surface of the plate may be painted with the first color and the second color. The foregoing has explained a case where the measurement jig 50 (150) and the scale 51 are formed separately. However, the measurement jig and the scale may be integrated with each other. The plate spring 30 has the plurality of colored portions 30*d* and 30*e* but may be configured to have one color. In FIG. 2, the side wall 18 located at an inner side in the car width direction does not have an opening opposed to a side surface of the middle portion 30*a* of the plate spring 30. However, the side wall 18 may have the same structure as the side wall 17 located at an outer side in the car width direction. The bogie 1 is a bogie with the bolster 3 but may be a bolsterless bogie.

REFERENCE SIGNS LIST

1 bogie
4 bogie frame
9 axle box
17 side wall
17*a* opening
17*b* side surface
30 plate spring
30*a* middle portion
30*c* side surface
40 lid
41 first plate
42 second plate
50, 150 measurement jig
M1, M2 marking

The invention claimed is:

1. A method of assembling a railcar bogie,
the method comprising:
a plate spring arranging step of making a pair of axle boxes support a plate spring extending in a car longitudinal direction, the axle boxes being arranged away from each other in the car longitudinal direction;
a bogie frame arranging step of placing a bogie frame directly or indirectly on a longitudinal direction middle portion of the plate spring from above, the bogie frame including a side wall on which an aperture is formed, the side wall covering the plate spring from an outside in a car width direction; and
a measuring step of measuring a positional deviation between the plate spring and the bogie frame in the car longitudinal direction through the aperture.

2. The method according to claim 1, wherein in the measuring step, by using a measurement jig configured to contact a car width direction outer side surface of the plate spring through the aperture, and when the measurement jig is provided along a car width direction outer side surface of the side wall, a positional deviation between a marking provided on the side surface of the side wall and a marking provided on the side surface of the plate spring in the car longitudinal direction is measured.

3. The method according to claim 1, further comprising an adjusting step of, when the measured positional deviation falls outside an allowable range, relatively moving the bogie frame and the plate spring in the car longitudinal direction to reduce the positional deviation.

4. The method according to claim 1, further comprising a lid attaching step of attaching a lid to the bogie frame, the lid closing the aperture.

5. A measurement jig configured to measure a positional deviation between a plate spring and a bogie frame, the plate spring extending in a car longitudinal direction and being supported by a pair of axle boxes arranged away from each other in the car longitudinal direction, the bogie frame including a side wall covering the plate spring from an outside in a car width direction, the side wall including an opening through which a side surface of the plate spring is exposed, the measurement jig comprising:

a vertical portion extending in a vertical direction along the side surface of the side wall, and a horizontal portion extending inward in the car width direction from an upper end of the vertical portion, wherein the horizontal portion includes:

a contact surface configured to be brought into surface contact with the side surface of the plate spring in a state that a normal line of the contact surface extends inward in the car longitudinal direction, and a mount surface configured to be mounted on a flat portion of a peripheral surface defining the opening of the bogie frame; and the vertical portion includes a measurement surface that is a vertical surface having a normal line extending in the car longitudinal direction, the measurement surface being configured to form an angle with the side surface of the side wall.

6. A railcar bogie comprising:

a plate spring extending in a car longitudinal direction and supported by a pair of axle boxes arranged away from each other in the car longitudinal direction; and a bogie frame including a side wall covering the plate spring from an outside in a car width direction, the side wall including an aperture through which a side surface of the plate spring is exposed, the bogie frame being placed directly or indirectly on a longitudinal direction middle portion of the plate spring from above.

7. The railcar bogie according to claim 6, further comprising a lid attached to the bogie frame and closing the aperture.

8. The railcar bogie according to claim 7, wherein:

the lid includes a first plate detachably fixed to the side wall and a second plate stacked on the first plate from an outside in the car width direction, the second plate being smaller in area than the first plate; and the first plate and the second plate have respective colors different from each other.

9. The railcar bogie according to claim 7, wherein:

a car width direction outer side surface of the side wall has a first color;

a car width direction outer side surface of a portion of the plate spring which portion extends to an outside of the side wall in the car longitudinal direction has a second color different from the first color; and a car width direction outer side surface of the lid has the second color.

* * * * *